US005645367A

United States Patent [19]

Gunter

[11] Patent Number: 5,645,367

[45] Date of Patent: Jul. 8, 1997

[54] DRAINAGE SYSTEM HAVING AN EMBEDDED CONDUIT CONNECTOR

[75] Inventor: Charles E. Gunter, Mooresville, N.C.

[73] Assignee: ABT, Inc., Troutman, N.C.

[21] Appl. No.: 500,832

[22] Filed: Jul. 11, 1995

[51] Int. Cl.[6] ..... E01C 11/22

[52] U.S. Cl. ..... 404/3; 404/2

[58] Field of Search ..... 404/2, 3, 4; 405/118, 405/119, 121, 124; 285/230, 201, 202, 203, 232, 255; 52/11

[56] References Cited

U.S. PATENT DOCUMENTS

| | | | |
|---|---|---|---|
| 2,518,620 | 8/1950 | Hughes | 210/239 |
| 2,701,027 | 2/1955 | Scoville | 126/162 |
| 2,938,437 | 5/1960 | Daley | 404/4 |
| 3,428,077 | 2/1969 | Scarfe | 137/363 |
| 4,838,727 | 6/1989 | Capuano | 404/2 |
| 5,366,318 | 11/1994 | Brancher | 405/36 |

OTHER PUBLICATIONS

Brochure entitled: *Trench Former® Oil Water Separator* by ABT, Inc., undated.

Brochure entitled: *Polydrain® Special Products* by ABT, Inc., undated.

Manual entitled: *Polydrain® The Simple Solution To Surface Drainage Sloped System Manual* by ABT, Inc., copyright 1992.

*Primary Examiner*—Henry A. Bennett

*Assistant Examiner*—Pamela A. O'Connor

*Attorney, Agent, or Firm*—Bell, Seltzer, Park & Gibson, P.A.

[57] ABSTRACT

A drainage system includes a conduit connector which is integrally molded within a precast drainage system component in order to provide for the interconnection of a variety of drainage system components, such as drainage channel sections and catch basins. The conduit connector can include a connector body which defines an aperture of a predetermined shape and size which are selected to match and snugly engage the conduit. The connector body further includes at least one locking anchor to secure the connector body against movement relative to the precast component. The locking anchor can include a longitudinal movement resisting anchor and/or a rotational movement resisting anchor. In order to further secure the conduit connector within the precast component, the wall of the precast component is substantially continuous about the conduit connector. In addition, the connector body preferably has a predetermined thickness which is no greater than the thickness of the precast component walls. Accordingly, the conduit connector will not protrude outwardly beyond the precast component, thereby enabling the precast component to be readily transported and stored without incurring significant risk of breakage due to inadvertent contact of the conduit connector with another object.

31 Claims, 4 Drawing Sheets

DRAINAGE SYSTEM HAVING AN EMBEDDED CONDUIT CONNECTOR

FIELD OF THE INVENTION

The invention relates to drainage systems having an embedded conduit connector. More particularly, the invention relates to a conduit connector which may be embedded in a precast component of a drainage system.

BACKGROUND OF THE INVENTION

Drainage systems, including drainage and other trenches of various sizes and shapes, are desirable for numerous applications. For example, manufacturing facilities typically require drainage systems which include trenches formed in the building floors to collect, remove and/or recycle excess water or other liquids. In addition, numerous outdoor industrial and commercial sites, such as large parking lots and airports, require drainage systems, including trenches, to collect and direct rainwater and other liquids to underground storm sewers to prevent flooding and to decrease run-off.

Drainage systems are generally formed by placing and securing a number of precast drainage channel sections in a ditch which has previously been formed in the ground. Typically, the drainage channel sections are formed from precast polymer/concrete or polymer/aggregate sections. A hardenable composition, such as cement, concrete or the like, is then poured around the drainage channel sections and is allowed to set.

In addition, drainage systems also typically include various conduits, collection basins, and the like which are connected to the drainage channels at outlets formed therein. The outlets may be formed on the side, end, or bottom of the drainage channel. Since the components of a drainage system can be spaced apart in the field, the components can be interconnected by pipes, such as PVC pipes, such that the components are in fluid communication. In order to facilitate this interconnection, a protruding length of pipe (i.e., a pipe stub) typically extends outwardly from a drainage channel section or other drainage system component. A pipe can then be connected to the pipe stub, such as by a pipe fitting, to interconnect the various drainage system components.

Conventionally, a pipe stub is installed in a drainage system component in the factory such that at least a portion of the pipe stub extends outwardly therefrom. For example, the pipe stub can be at least partially embedded within a drainage system component, such as the end plate of a drainage channel, during the formation or molding of the drainage system component.

Alternatively, the pipe stub can be installed in the drainage system component in the field within a hole formed in the drainage system component. For example, an appropriately sized hole can be formed in the drainage system component to receive at least a portion of the pipe stub. The pipe stub can then be secured, such as with an adhesive, within the hole. Regardless of the method by which the pipe stub is installed, the pipe stub typically extends outwardly from the drainage system component by a distance equal to about the cross-sectional diameter of the pipe stub.

Numerous examples of drainage systems have been disclosed which employ such pipe stubs. For example, U.S. Pat. No. 2,518,620 to Hughes discloses a catch basin for receiving liquid drainage and for discharging the liquid to drainage pipes. The catch basin is formed of several separate sections which are stacked to form the resulting basin structure. Matching partial apertures in these sections are aligned to form apertures in the sidewalls of the basin structure. A spigot connector can be positioned within the partial apertures so as to be trapped and held within a respective aperture once the sections are joined. The spigot connector extends outward from the basin structure and serves to connect the basin to various drainage pipes.

U.S. Pat. No. 2,938,437 to Daley discloses drainage receivers which are connected in various combinations with underground piping so as to direct water flow through a sewer system. In particular, a single receiver is provided which receives the water collected by a number of other receivers and which provides the water to the sewer system. Accordingly, the drainage receiver of the Daley '437 patent includes various necks which extend outwardly therefrom to adaptively connect outlets of the single receiver to the other receivers.

U.S. Pat. No. 3,428,077 to Scarfe also discloses a underground system for the disposal of surface water and soil. Specifically, the system of the Scarfe '077 patent includes an access pit having multiple inlets and an outlet. The access pit is set in concrete beneath the ground surface. Connector sleeves which are formed of relatively short pipe lengths extend through the access pit inlet and outlets and protrude outwardly beyond the concrete. The short pipe lengths are, in turn, connected with drainage pipes to allow water and soil to drain from the access pit.

In spite of the widespread use of pipe stubs to interconnect the various components of a drainage system, the use of pipe stubs has been found to be disadvantageous for several reasons. In particular, storage and transportation of drainage system components which have a pipe stub extending outwardly therefrom can be difficult and awkward since the outwardly extending pipe stub increases the size and fragility of the structure. More specifically, during transportation and storage of the drainage system component, the pipe stub can be bumped or otherwise impacted which, in turn, fracture the pipe stub, the drainage system component, or both. In addition, the outwardly extending pipe stub further complicates storage of the drainage system components since the pipe stub does not readily permit close stacking or nesting of the components.

Alternatively, if the pipe stub is installed in the field, a hole of relatively precise dimensions must be formed in the drainage system component in order to properly receive and mate with the pipe stub. However, the materials which form the drainage system components are relatively brittle. In particular, drainage system components which are formed from a combination of a polymeric resin and aggregate material are relatively brittle, especially as the percentage by weight of aggregate material increases. Accordingly, all or a part of the drainage system component could shatter during formation of the hole therein.

Regardless of the method by which the pipe stub is installed, a pipe fitting must generally be employed to secure a pipe to the outwardly extending portion of the pipe stub. The use of a pipe fitting to couple the pipe stub to a pipe, not only increases the number of components required to assemble the drainage system and the resulting cost of the drainage system, but also forms an additional joint through which liquid may leak.

SUMMARY OF THE INVENTION

In view of the foregoing, it is an object of the present invention to provide a drainage system which allows conduit to be readily connected to various components of the drainage system.

It is another object of the present invention to provide a conduit connector capable of being embedded within a precast component of a drainage system which allows the precast components to be efficiently stacked, stored and transported while reducing the possibility of damage to the precast components during such stacking, storage and transportation.

It is a further object of the present invention to provide a conduit connector capable of being embedded within a precast component of a drainage system in the factory such that the precast component is not damaged during installation of the conduit in the field.

These and other objects are provided, according to the present invention, by a drainage system including a conduit connector capable of interconnecting various drainage system components, such as, for example, a drainage channel and a conduit. In accordance with one aspect of the present invention, the conduit connector includes at least one locking anchor which secures the conduit connector against movement within a wall of a precast component of a drainage system such that the conduit connector can readily receive a conduit. According to one advantageous embodiment, the conduit connector is embedded within the wall of the precast component such that the conduit connector does not protrude substantially beyond the inner and outer surfaces of the wall. Accordingly, the transportation and storage of a drainage system component including the conduit connector of the present invention is facilitated and the possibility of damaging the drainage system component during such transportation and storage is reduced.

The conduit connector includes a connector body, preferably formed of a thermoplastic material, which defines an aperture therethrough. The aperture has a predetermined size and shape for receiving a conduit and, in one preferred embodiment, is sized to match and snugly engage a conduit of a predetermined, e.g., standard, size. The connector body also defines a longitudinal axis extending through the aperture.

In accordance with one embodiment of the present invention, the connector body has an outer surface which includes at least one locking anchor to secure the connector body against movement when embedded within the precast component. In one advantageous embodiment, the locking anchor includes a longitudinal movement resisting anchor for securing the connector body against longitudinal movement relative to the precast component. The longitudinal movement resisting anchor of one embodiment extends both circumferentially about the outer surface of the connector body and outwardly from a medial portion of the outer surface of the connector body. Moreover, the longitudinal movement resisting anchor is adapted to be received by a corresponding groove which is formed within the precast component.

In an alternative embodiment, the longitudinal movement resisting anchor can include a circumferentially extending groove defined within the connector body. In this embodiment, the longitudinal movement resisting anchor extends radially inward into the connector body and is adapted to receive a corresponding rib of the precast component.

The locking anchor can also include a rotation resisting anchor, in addition to or instead of the longitudinal movement resisting anchor, for securing the body against rotational movement about a longitudinal axis relative to the precast component. For example, the rotation resisting anchor can include one or more of angularly spaced apart longitudinally extending ribs. The rotation resisting anchor can also be received and held within a corresponding groove defined within an interior portion of the precast component.

In order to further secure the conduit connector within the precast component, the conduit connector can be advantageously integrally molded into the precast component such that at least the portion of the wall of the precast component which surrounds the conduit connector is substantially continuous. In addition, to the precast component and the conduit connector, the drainage system can include a conduit positioned within the aperture defined by the connector body. The conduit of one advantageous embodiment has a predetermined shape and size which matches the predetermined size and shape of the aperture defined by the connector body. As a result, the conduit of this embodiment can be frictionally engaged by the connector body. However, the conduit can be secured to the connector body by other means, such as, for example, a layer of adhesive without departing from the spirit and scope of the present invention.

A drainage system including a conduit connector of the present invention provides numerous advantages. For example, since the conduit connector is embedded within the precast component and, according to one embodiment, is preferably sized so as not to protrude beyond the precast component, the possibility of damaging the conduit connector or the precast component during transportation and storage is greatly minimized. Moreover, since the conduit connector is embedded within the precast component during casting of the component in the factory, the precast component need not be modified in the field, such as by forming a hole therein, thereby further reducing the possibility of damaging the precast component. Furthermore, the conduit connector of the present invention offers increased stability due, at least in part, to the locking anchor which securely engages an interior portion of the precast component. The cost of a drainage system including one or more conduit connectors is also reduced since pipes can be connected to the conduit connectors without pipe fittings. As a result, the reliability of the drainage system is enhanced since the coupling of a pipe to the conduit connector does not create another joint.

BRIEF DESCRIPTION OF THE DRAWINGS

In the drawings which form a portion of the original disclosure of the invention.

DETAILED DESCRIPTION OF THE PREFERRED EMBODIMENT

Figure 1:
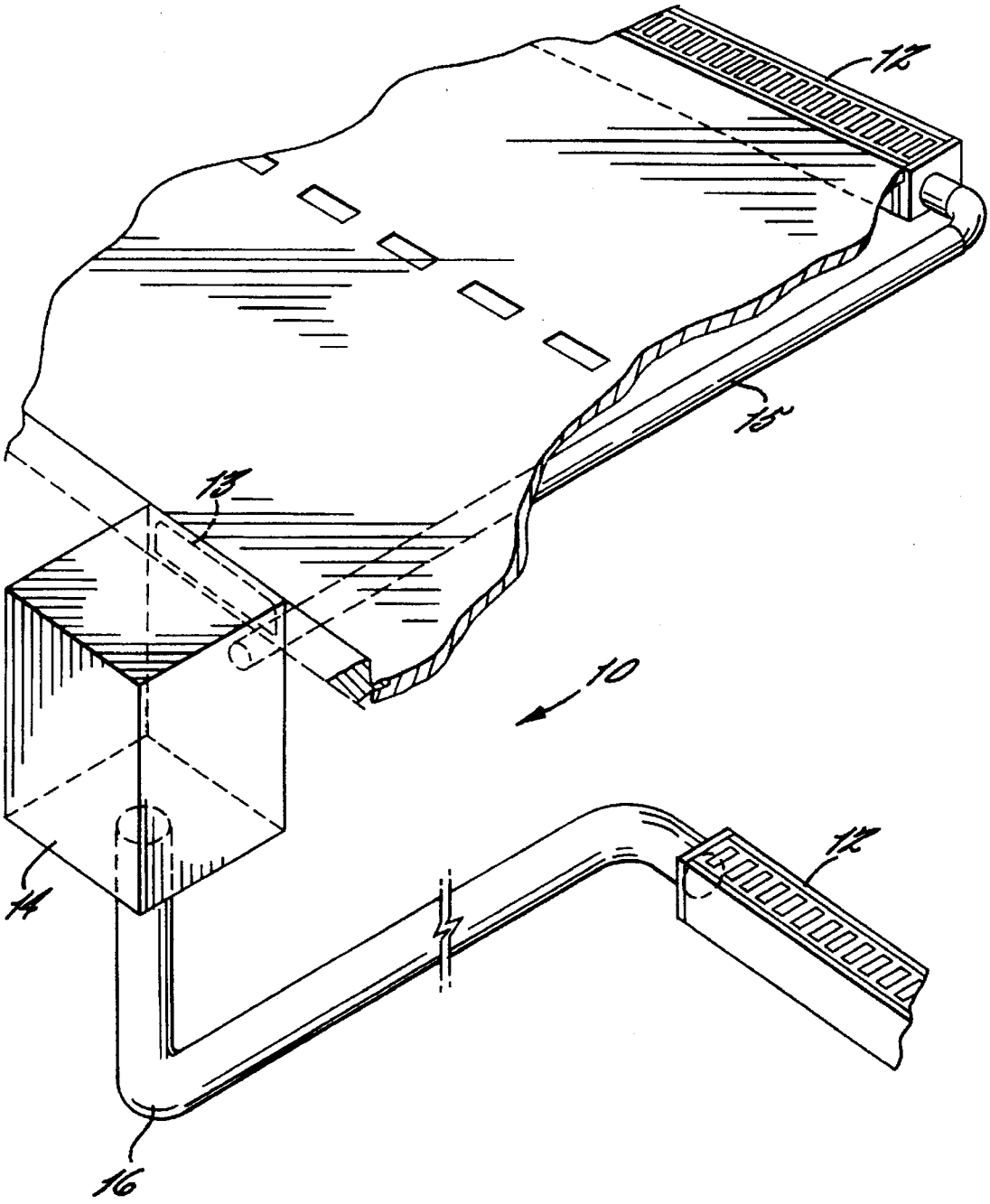
FIG. 1 is an environmental view of a drainage system of one embodiment of the present invention in which a drainage channel is connected via a conduit to a catch basin and in which both the drainage channel and the catch basin include a conduit connector embedded therein for accepting an end portion of the interconnecting conduit.

Various apparatus embodiments of the invention are set forth below. While the invention is described with reference to the specific preferred apparatus including those illustrated in the drawings, it will be understood that the invention is not intended to be so limited. To the contrary, the invention includes numerous alternatives, modifications, and equivalents as will become apparent from consideration of the present specification including the drawings, the foregoing discussion, and the following detailed description.

Referring now to FIG. 1, a conventional drainage system 10 is depicted which may serve to transport fluid (e.g., ground and/or waste water), along with solid sediment to a body of water (e.g., reservoir, lake, or river), or to a treatment or storage facility. Irrespective of the type of fluid transported through the drainage system, the drainage system includes a liquid collection structure (e.g., a catch basin 14 or a grated drainage channel 12) to collect liquid run-off from the surrounding surfaces. As illustrated, the drainage system can include a catch basin 14 which includes one or more side openings 13 through which fluid is collected. As also illustrated, the drainage channel 12 can include a bottom wall and opposed sidewalls which extend upwardly from opposite sides of the bottom wall. The drainage channel also includes a grate extending between upper edges of the opposed sidewalls and defining a number of slots through which fluid is collected within the drainage channel. Although specific embodiments of the catch basin and drainage channel are illustrated and described herein, the drainage system of the present invention can include other types of catch basins and drainage channels or other types of liquid collection structures known to those skilled in the art without departing from the spirit and scope of the present invention.

Figure 2:
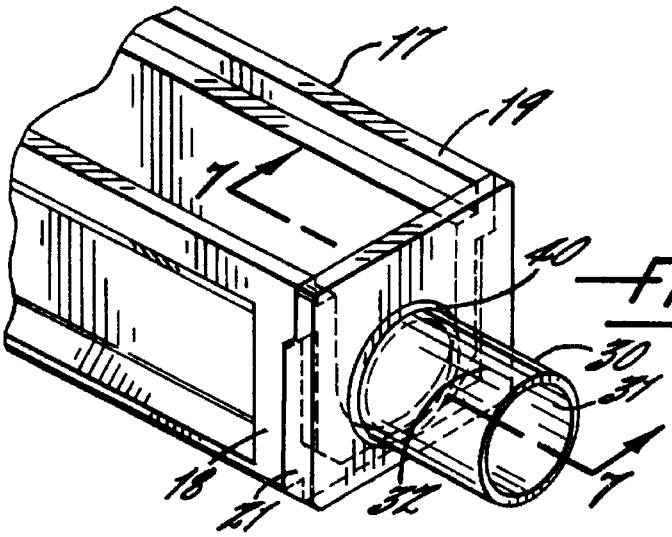
FIG. 2 is a perspective view of a drainage channel section including an end plate in which a conduit connector according to one embodiment of the present invention is embedded and through which a conduit is inserted.
Figure 3:
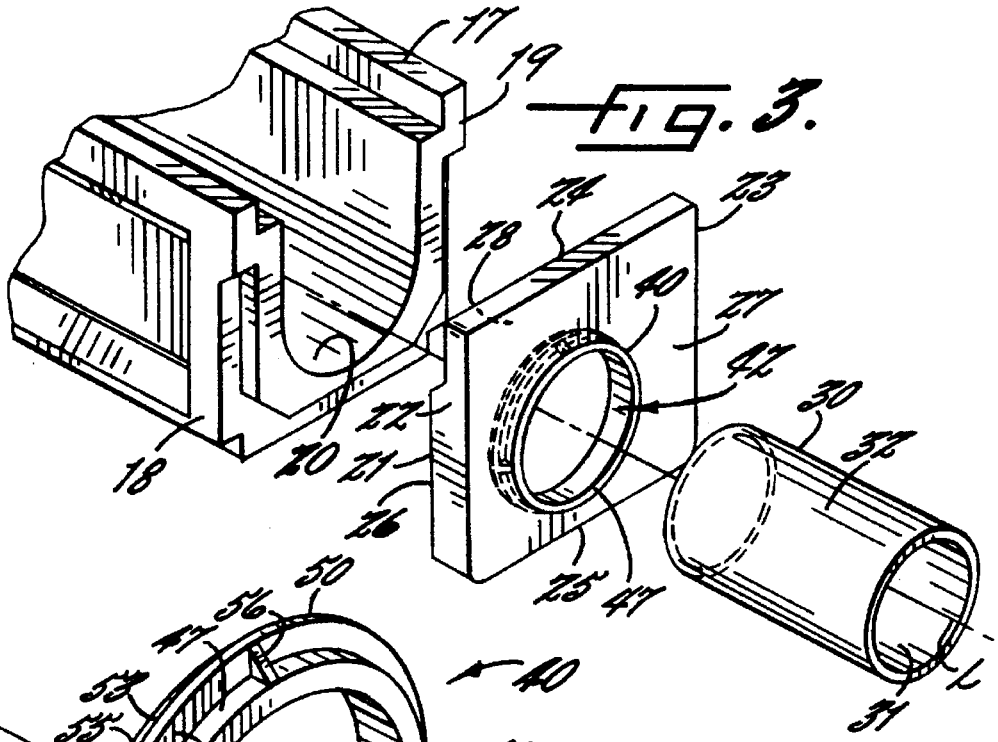
FIG. 3 is an exploded perspective view of the drainage channel section and associated conduit of FIG. 2 illustrating the embedding of a conduit connector according to one embodiment of the present invention within the end plate of the drainage channel section.

As shown in FIGS. 2 and 3, the drainage channel 17 can include a bottom wall 20 and sidewalls 18 and 19 extending upwardly from opposite sides of a bottom wall 20. The bottom wall 20 can either be inclined at a predetermined angle to facilitate fluid flow therethrough, or can be substantially level as known to those skilled in the art. The precast component, such as drainage channel 17, can be formed from any suitable material, such as a cementicious and/or thermosetting or thermoplastic polymeric material. For example, the drainage channel can be formed from a polymer/concrete aggregate material. More particularly, the drainage channel of one advantageous embodiment is formed from a thermosetting polymeric resin, such as acetone, and an aggregate material. The aggregate material is preferably a chemically inert material, such as silica or glacial till. In one embodiment, the drainage channel includes greater than about 85% by weight of aggregate.

As also known to those skilled in the art, catch basins and drainage channels can be employed in numerous types of industrial and municipal settings. For example, as depicted in FIG. 1, these structures can be positioned along a street to collect water and other fluids. In addition, catch basins 14 and drainage channels 12 can be disposed within other large paved areas, such as a parking lot. As an example, a catch basin can be positioned within a depressed region of a large paved area to collect liquid run-off therefrom.

As shown in FIG. 1, the fluid and sediment collected by the catch basin 14 and the drainage channel 12 of the drainage system are preferably provided to a collection facility or a sewer system. In the illustrated embodiment, fluid collected by the drainage channel 12 flows through a conduit 15 to a catch basin 14. The catch basin is also in fluid communication with another conduit 16 which drains the fluid from the catch basin and which carries the fluid at least a portion of the way to a treatment facility, reservoir, lake, river, or the like.

In order to connect the conduit to various drainage system components, such as drainage channels and catch basins, the drainage system also includes a conduit connector. As illustrated in FIGS. 2 and 3, a conduit connector 40 according to the present invention is embedded within a precast component 21 of the drainage system. For example, the precast component can be a drainage channel section, a catch basin or the like. More specifically, as shown in FIGS. 2 and 3, the precast component can be an end plate which is mounted to the end portion of drainage channel 17. However, the conduit connector 40 can be embedded in precast drainage channel components, including, for example, the side or bottom wall of the drainage channel 17 or the side or bottom wall of a catch basin. As also shown in FIGS. 1–3, the conduit connector 40 effectively connects a conduit 30 to the drainage system component in which the conduit connector is embedded. For example, the conduit can serve as either an inlet or an outlet to the drainage system component as shown in FIG. 1. Alternatively, a pair of conduit connecters can be embedded in opposite walls of a drainage system component in a predetermined aligned relationship such that a conduit can extend through both of the aligned conduit connectors, thereby passing through the drainage system component without being in fluid communication therewith.

The conduit 30 is typically an elongated annular pipe having inner and outer circumferentially extending surfaces, 31 and 32 respectively. The conduit 30 can have a variety of sizes, but is typically sized to support a predetermined maximum load or fluid flow rate. As described in conjunction with the drainage channel, the conduit 30 can be formed of a variety of materials which are selected based upon the load requirements and type of fluid which the conduit is designed to transport. Accordingly, the conduit can be formed of a variety of cementicious, polymeric or metal materials and, in one embodiment, is formed of polyvinyl chloride ("PVC").

In the illustrated embodiment, the precast component 21 includes a wall 26 having side, top, and bottom peripheral edge surfaces 22, 23, 24, and 25 respectively. As shown, the wall 26 has an inner surface 28 which faces the interior of the drainage channel 17 and an opposed outer surface 27 which is positioned exterior to the drainage channel. The opposed wall surfaces 27 and 28 are joined by side, top, and bottom peripheral edge surfaces 22–25. In addition, the wall of the precast component has a predetermined thickness, such as between about ½ inch and about 2 inches in one exemplary embodiment.

As shown in FIG. 2, the precast component 21 can be an end plate or a bottom plate which is affixed to a drainage system component, such as a drainage channel, such that the side and bottom edge surfaces 22, 23, and 25 of the end plate contact the upwardly extending sidewalls 18 and 19 and bottom surface 20 of the drainage channel 17. However, the precast component need not be a plate which is affixed to a drainage system component as shown in FIGS. 2 and 3. Instead, the precast component can be the drainage system component itself, such as a drainage channel section or a catch basin, as described above.

In either instance, the precast component 21 is preferably formed of a unitary body so as to extend in a substantially continuous manner about the conduit connector 40. Nonetheless, it should be noted that other variations in the structure of the precast component are possible without departure from the spirit and scope of the invention. For example, the precast component 21 may comprise a plurality of sections which can be secured together according to any appropriate and known technique such as, for example, adhesive bonding.

In the embodiment illustrated in FIGS. 2 and 3, a conduit connector 40 is embedded within precast component 21. Preferably, the conduit connector 40 is embedded within the precast component by being integrally molded within the cementicious material forming the precast component during the casting of the component 21.

The conduit connector 40 can also be formed of a variety of different materials including a number of thermosetting or thermoplastic polymeric materials, such as PVC, without departing from the spirit and scope of the present invention. However, the conduit connector is preferably formed of a material which is compatible with the material from which the conduit is formed. In other words, the conduit connector is preferably formed of a material which is capable of being solvent bonded or welded to the material from which the conduit is formed. Accordingly, for drainage systems including PVC conduits, the conduit connector is also preferably formed of PVC so that the conduit connector can be solvent bonded or welded with an appropriate solvent, such as acetone, to the conduit.

Figure 4:
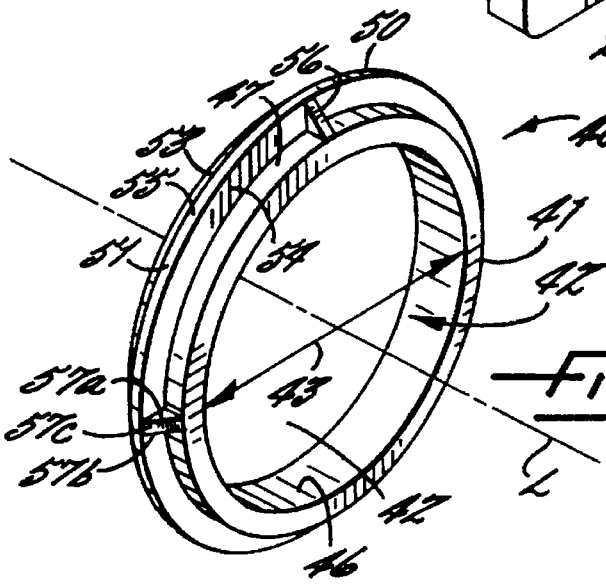
FIG. 4 is a perspective view of a conduit connector according to one embodiment of the present invention which includes both a rotation resisting anchor and a longitudinal movement resisting anchor.
Figure 5:
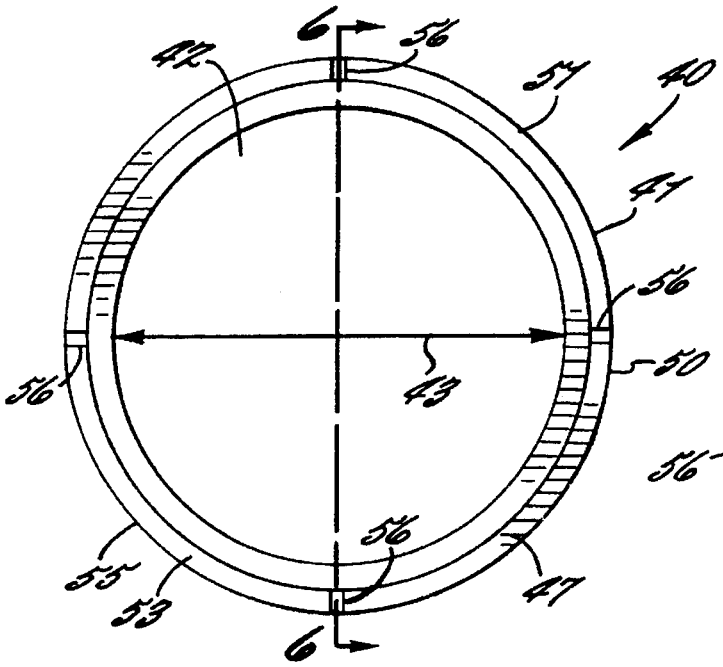
FIG. 5 is a transverse cross-sectional view of the embodiment of the conduit connector of FIG. 4.

As shown in more detail in FIGS. 4 and 5, the conduit connector 40 includes an annular, ring-like connector body 41 defining an aperture 42 therein. In one advantageous embodiment, the aperture 42 defined by the connector body 41 has a predetermined shape and size for receiving the conduit 30 such that the conduit 30 and the drainage system component in which the conduit connector is embedded are in fluid communication, i.e., fluid can be transported from or to the conduit and the drainage system component. Preferably, the aperture 42 defined by connector body 41 has an inner diameter 43 which is sized to match and snugly engage the conduit 30. For example, in one advantageous embodiment, the conduit is preferably frictionally engaged within the aperture defined by the connector body.

While the conduit and, consequently, the aperture defined by the connector body can have a variety of sizes without departing from the spirit and scope of the present invention, the outer diameter of the conduit and the diameter of the aperture defined by the connector body are typically between about 2 inches and about 10 inches. In addition, although the conduit and the aperture 42 of the connector body 41 are depicted in FIG. 3 as being circularly shaped, the conduit and the aperture can have other shapes, such as oval, rectangular, trapezoidal or triangular shapes without departing from the spirit and scope of the present invention.

As described herein, the wall 26 of precast component 21 has a predetermined thickness, such as between about ½ inch and about 2 inches. In one advantageous embodiment of the present invention, the connector body 41 has a thickness which is no greater than the thickness of the substantially continuous wall 26 of the precast component 21 in which the conduit connector 40 is embedded. In other words, the thickness of the connector body is preferably equal to or less than the thickness of the wall of the precast component.

Accordingly, the conduit connector 40 preferably does not protrude outwardly beyond the inner and outer surfaces 26 and 27 of the precast component 20, but is, instead, flush or below flush relative to the wall 25. The conduit connector 40 and the precast component in which the conduit connector is embedded is therefore less likely to be impacted and break, thus facilitating transportation and storage of the precast component in which the conduit connector is embedded.

Figure 6:
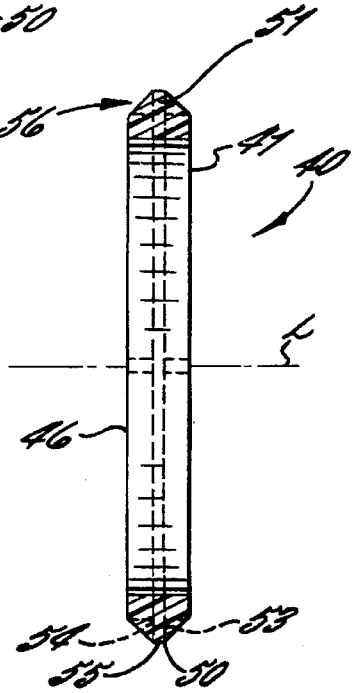
FIG. 6 is a side view of the embodiment of the conduit connector of FIG. 4.
Figure 7:
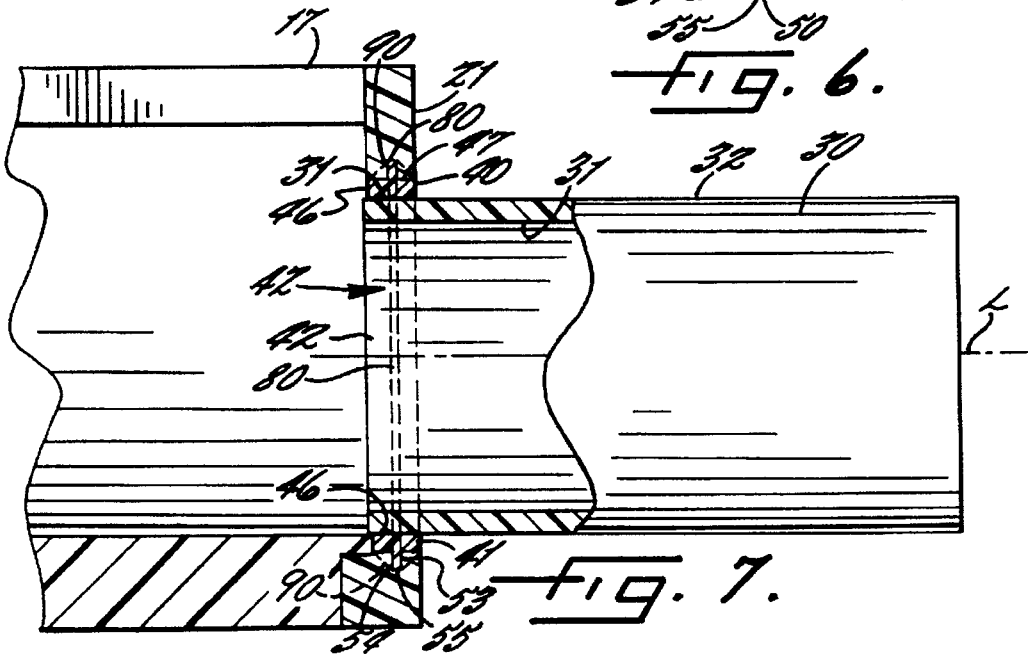
FIG. 7 is a longitudinal cross-sectional view of the drainage channel section and associated conduit of FIG. 2 illustrating the embedding of a conduit connector according to one embodiment of the present invention within an end plate of the drainage change section.

As shown in greater detail in FIGS. 4, 6 and 7, the connector body 41 defines a longitudinal axis L which extends through the aperture 42. In addition, the connector body 41 of the illustrated embodiment includes inner and outer surfaces 46 and 47 which extend circumferentially around connector body 41. The inner surface 46 preferably defines the shape and size of the aperture and the outer surface typically engages portions of the wall of the precast component.

As further illustrated in FIG. 4, the outer surface 47 of the connector body 41 has at least one locking anchor 50, such as an outwardly projecting rib, which extends circumferentially around the outer surface 47 of the connector body 41. The locking anchor 50 is engaged by the precast component so as to secure the connector body against movement relative to the precast component 21. As shown, the locking anchor 50 can be an integral part of the connector body 41, or can be a separate structure which is attached to the outer surface 47 of the connector body, such as by the use of adhesive, for example.

Figure 9:
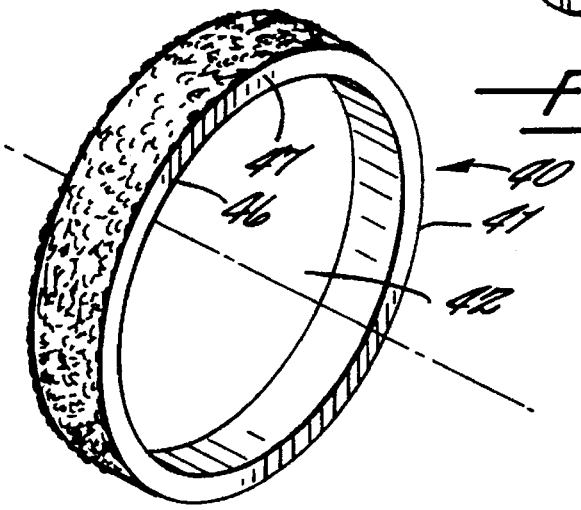
FIG. 9 is a perspective view of a conduit connector according to another embodiment of the present invention which includes a textured outer surface.

Although rib-like locking anchor is illustrated and described herein, the locking anchor can include a variety of other structures which secure the connector body 41 against relative movement to the precast component. For example, the outer surface 47 of the connector body 41 can be textured so as to effectively engage the precast component and secure the connector body therein. See FIG. 9.

As illustrated, the locking anchor 50 preferably includes a longitudinal movement resisting anchor and/or a rotation resisting anchor. As shown in FIG. 4, the locking anchor 50 can include a longitudinal movement resisting anchor to secure the connector body 41 against longitudinal movement relative to the precast component. The longitudinal movement resisting anchor 51 can include a rib extending outward from a medial portion of the outer surface 47 of the connector body 41. The outwardly projecting rib generally has opposed radially extending surfaces 53 and 54, and an edge surface 55 which connects the radially extending surfaces 53 and 54.

In one advantageous embodiment, the longitudinal movement resisting anchor 51 extends circumferentially about the outer surface 47 of the connector body 41 and outwardly in a direction substantially perpendicular to the longitudinal axis L. However, the longitudinal movement resisting locking anchor 51 can extend outwardly at other angles relative to the longitudinal axis without departing from the spirit and scope of the present invention. In addition, while the longitudinal movement resisting locking anchor preferably extends outwardly from a medial portion of the outer surface of the connector body, the longitudinal movement resisting locking anchor can extend outwardly from other portions of the outer surface of the connector body without departing from the spirit and scope of the present invention.

While the longitudinal movement resisting locking anchor 51 can be of any appropriate size without departing from the spirit and scope of the present invention, the longitudinal movement resisting anchor of the illustrated embodiment preferably extends outwardly from the outer surface of the connector body by a distance equal to about one-quarter of the wall thickness of the precast component 21. Additionally, the thickness of the illustrated embodiment of the longitudinal movement resistant anchor is preferably between about one-tenth to about one-half of the wall thickness of the precast component.

The locking anchor 50 of the conduit connector of the present invention also advantageously includes a rotation resisting anchor 56 for securing the connector body 41 against rotational movement relative to the precast component and about the longitudinal axis L of the conduit connector. As illustrated in FIGS. 4–7, the rotation resisting anchor 56 of one embodiment includes one or more longitudinally extending ribs which extend outwardly from the outer surface 47 of the connector body 41 As also shown in FIGS. 4–7, the longitudinally extending ribs can also be connected at their side portions to the longitudinal movement resisting anchor 51 and can extend longitudinally outward in both directions therefrom.

As best illustrated in FIG. 6, the ribs are typically arranged in sets of two, in which the ribs of each set are located at the same angular position on the connector body 41 and extend in opposite longitudinal directions. For example, in the illustrated embodiment, the rotation resisting anchor includes four sets of ribs which are spaced apart at equal angular interval (i.e., 90 degrees) about the connector body. However, the rotation resisting anchor can include any number of sets of ribs which are positioned at any regular or irregular angular intervals without departing from the spirit and scope of the present invention. Additionally, the ribs need not be arranged in sets, but can instead be staggered about the circumference of the connector body.

While a rotation resisting anchor which includes one or more outwardly extending ribs is described and illustrated herein, the rotation resisting anchor can include other means of engaging surrounding portions of the precast component 21 and preventing relative rotation therewith without departing from the spirit and scope of the present invention. For example, the rotation resisting anchor can include a number of holes or pockets which extend inwardly into the connector body 41 from the outer surface thereof. Accordingly, the precast component can include correspondingly shaped projections which extend into the holes or pockets and prevent relative rotation therewith.

As shown in FIG. 4, each rib typically includes opposed surfaces 57*a* and 57*b* which engage corresponding portions of the precast component so as to resist rotation about the longitudinal axis of the connector body. Each rib can also include an edge surface 57*c* connecting the opposed surfaces 57*a* and 57*b*. The ribs are preferably sufficiently thick to structurally withstand the forces imparted to the ribs during attempted rotation of the conduit connector or the precast component. For example, in one embodiment, the thickness of the ribs is between about 0.06 inches and about 0.15 inches.

While the conduit connector 40 illustrated and described herein includes a locking anchor 50 which has separate longitudinal movement resisting and rotation resisting anchors, the locking anchor can include a single anchor which secures the conduit connector against both longitudinal and rotational movement without departing from the spirit and scope of the present invention. For example, the connector body 41 can include an outwardly extending post or gear-type structure which engages the precast component and prevents relative rotation and longitudinal movement therebetween.

As shown in FIG. 7, the conduit connector 40 of the present invention is preferably integrally molded within a precast component 21, such as the end plate of a drainage channel section. A conduit 30 can thereafter be mounted within the aperture defined by the conduit connector. As discussed herein, the conduit 30 is preferably of a predetermined size and shape which matches the predetermined size and shape of the aperture 42 defined by the connector body 41 such that the conduit 30 may be snugly received, and in one advantageous embodiment, frictionally engaged by the connector body 41. However, other means of securing the conduit 30 to the connector body 41 can also be employed without departing from the spirit and scope of the present invention. For example, a layer of adhesive can be disposed between the inner surface 46 of the connector body 41 and the outer surface 31 of the conduit 30. Alternatively, the conduit 30 can be secured to the connector body 41 by a number of other methods including, for example, a solvent bonding or welding technique or a thermal welding or fusing technique.

As further illustrated in FIG. 7, the precast component preferably has grooves defined therein which receive and hold the locking anchors, including the longitudinal movement resisting anchor and the rotation resisting anchor. The grooves may be formed by any appropriate method. Typically, however, the grooves are formed by molding the precast component 21 about the conduit connector 40.

As illustrated, the precast component typically defines a first groove 80 which extends circumferentially about the conduit connector and includes two opposed inner walls which extend radially inward and which correspond in size and shape to the surfaces 53 and 54 of the longitudinal movement resisting anchor 51. The inner walls of the first groove can be connected by a bottom wall which has a outer surface corresponding in size and shape to the edge surface 55 of the longitudinal movement resisting anchor 51. As also shown, the precast component can further define a plurality of second grooves 90 sized and shaped to correspond to the ribs forming the rotation resisting anchor 56. More particularly, each second groove 90 of the illustrated embodiment preferably has a pair of opposed walls which are sized and shaped to correspond to the outer surfaces 57*a* and 57*b* of rib.

Figure 8:
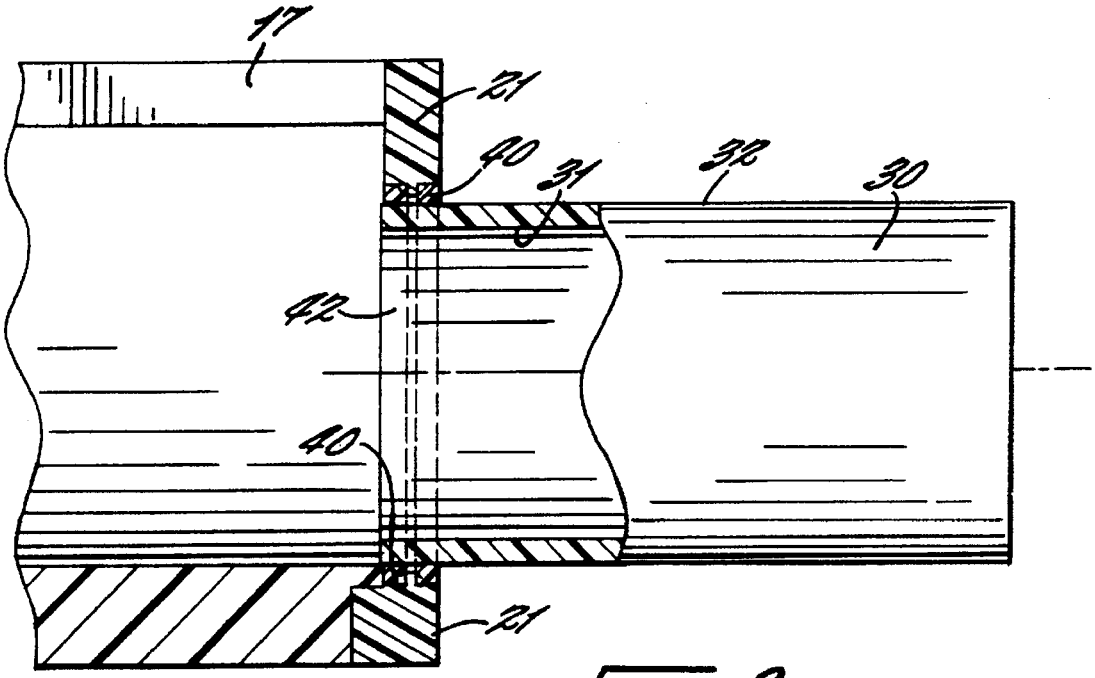
FIG. 8 is a longitudinal cross-sectional view of a drainage channel section and an associated conduit illustrating the embedding of a conduit connector having a circumferentially extending groove for receiving a corresponding rib of the precast component, such as an end plate of the drainage channel section.
Figure 8A:
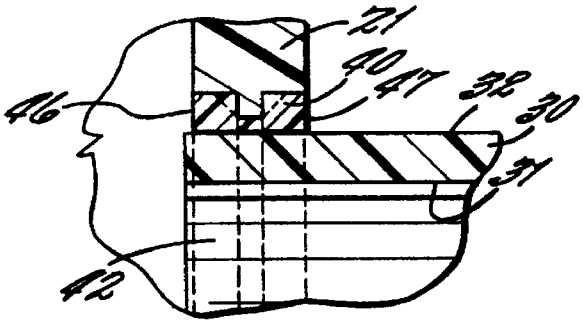
FIG. 8A is an enlarged cross-sectional view of a portion of FIG. 8 which illustrates in more detail the circumferentially extending groove defined by the outer surface of the conduit connector and the corresponding rib of the precast component which engages the circumferentially extending groove.

As shown in FIGS. 8 and 8A, the longitudinal movement resisting anchor 51 and/or the rotation resisting anchor 56 can be formed by grooves defined within the outer surface of the connector body 41, instead of the outwardly projecting ribs as shown and described above. In order to secure the connector body 41 of this embodiment within the wall of the precast component, the precast component 20 preferably includes ribs sized and shaped to be received within and held by the grooves defined within the connector body.

In particular, a longitudinal movement resisting anchor of this embodiment can include a groove formed within the connector body and extending both radially inward and circumferentially about the connector body. Accordingly, the precast component of this embodiment preferably has a corresponding inwardly projecting rib which is adapted to be received by the circumferentially-extending groove. Likewise, the rotation resisting anchor can include a plurality of grooves which extend both inwardly into the outer surface of the connector body and longitudinally therealong. Accordingly, the precast component can include a number of corresponding ribs which extend both longitudinally and radially inward so as to be received within corresponding ones of the longitudinally extending grooves defined by the connector body.

In accordance with the present invention, a conduit connector can be embedded within a precast component of a drainage system to allow the ready attachment of a conduit thereto. Thus, a pipe can be connected to the conduit connector without a pipe fitting, thereby reducing the cost of the resulting drainage system and decreasing the number of joints.

Further, the conduit connector of the present invention eliminates the need to mold a pipe stub into drainage channel components in order to attach conduit thereto. As a result, the possibility of damaging the drainage channel components problems is reduced since the drainage channel components do not include an outwardly extending pipe stub which can be impacted during handling of the drainage channel components and since a hole need not be formed in the drainage channel components in the field in order to receive a pipe stub. Moreover, stacking and nesting of drainage channel components which include the conduit connector of the present invention is facilitated since the drainage channel components do not contain an outwardly extending pipe stub.

The invention has been described in detail with reference to its preferred embodiments. However, it will be apparent that numerous variations and modifications can be made without departure from the spirit and scope of the invention as described in the foregoing detailed specification and claims.

That which is claimed is:

1. A drainage system comprising:

a precast component comprising a wall having opposed exterior and interior surfaces; and a conduit connector integrally molded within said wall of said precast component such that at least the portion of the wall of said precast component which surrounds said conduit connector is substantially continuous, said conduit connector comprising a connector body defining an aperture having a predetermined shape and size for receiving a conduit such that the conduit and at least a portion of the drainage system are in fluid communication, said connector body further comprising an outer surface having at least one locking anchor, wherein said at least one locking anchor comprises a longitudinal movement resisting locking anchor to engage the precast component and to secure said connector body against longitudinal movement relative to the precast component, said longitudinal movement resisting anchor extending outwardly from a medial portion of said outer surface of said connector body, and wherein an interior portion of said wall of said precast component defines a groove to receive and hold said longitudinal movement resisting anchor.

2. A drainage system according to claim 1, wherein the exterior and interior surfaces of the wall have respective predetermined shapes and wherein said connector body has a predetermined thickness such that said connector body does not protrude outwardly and alter the shapes of the exterior and interior surfaces.

3. A drainage system according to claim 1, wherein said conduit connector comprises thermoplastic material and wherein said precast component comprises a combination of a thermosetting polymer resin and an aggregate material, and wherein said precast component comprises at least 85% by weight of aggregate material.

4. The drainage system according to claim 1, further comprising a conduit positioned within the aperture defined by said connector body.

5. A drainage system according to claim 4, wherein said conduit has a predetermined size and shape which corresponds to the predetermined size and shape of the aperture defined by said connector body such that said conduit is frictionally engaged by said connector body.

6. A drainage system according to claim 4, further comprising a layer of adhesive disposed between said connector body and said conduit to secure said conduit to said connector body.

7. A drainage system according to claim 1, wherein said longitudinal movement resisting anchor includes a circumferentially extending groove within said connector body wherein said circumferentially extending groove extends radially inward into said connector body to receive a corresponding rib of the precast component.

8. A drainage system according to claim 1, wherein said connector body defines a longitudinal axis extending through the aperture of said connector body, and wherein said at least one locking anchor comprising a rotation resisting anchor to engage the precast component and to secure the connector body against rotational movement about the longitudinal axis relative to the precast component.

9. A drainage system according to claim 8, wherein the rotation resistant anchor comprises at least one angularly spaced apart longitudinally extending rib.

10. A unitary conduit connector which secures a conduit to a precast component of a drainage system, the conduit connector comprising:

a unitary connector body defining an aperture having a predetermined shape and size to receive the conduit, said connector body also defining a longitudinal axis extending through the aperture, and said connector body comprising an outer surface having at least one locking anchor to engage the precast component and to secure the connector body against movement within the precast component of the drainage system, said at least one locking anchor comprising a rotation resisting anchor, integral with said connector body, to engage the precast component, thereby securing the connector body against rotational movement about the longitudinal axis relative to the precast component.

11. A conduit connector according to claim 10, wherein the precast component has a substantially continuous wall of predetermined thickness and said connector body has a thickness which is no greater than the thickness of the substantially continuous wall of the precast component in which the conduit connector is embedded such that the conduit connector does not protrude outwardly beyond the precast component.

12. A conduit connector according to claim 10, wherein said at least one locking anchor further comprises a longitudinal movement resisting anchor to engage the precast component and to secure said connector body against longitudinal movement relative to the precast component.

13. A conduit connector according to claim 12, wherein said longitudinal movement resisting anchor extends circumferentially about the outer surface of said connector body and outwardly from a medial portion of the outer surface of said connector body.

14. A conduit connector according to claim 12, wherein said longitudinal movement resisting anchor includes a circumferentially extending groove within said connector body wherein said circumferentially extending groove extends radially inward into said connector body to receive a corresponding rib of the precast component.

15. A conduit connector according to claim 10, wherein the outer surface of said connector body includes a textured outer surface which comprises said at least one locking anchor.

16. A conduit connector according to claim 10, wherein the rotation resisting anchor comprises at least one angularly spaced apart longitudinally extending rib.

17. A conduit connector according to claim 10, wherein the aperture of said connector body has an inner diameter which is sized to snugly engage the conduit.

18. A conduit connector according to claim 10, wherein said connector body comprises thermoplastic material.

19. A unitary conduit connector which secures a conduit to the precast component of the drainage system, the conduit connector comprising:

a unitary connector body defining an aperture having a predetermined shape and size to receive the conduit, and said connector body comprising an outer surface having at least one locking anchor, integral with said connector body, to engage the precast component and to secure the connector body against movement within the wall of the precast component of the drainage system, wherein said at least one locking anchor comprises a longitudinal movement resisting anchor to engage the precast component and to secure said connector body against longitudinal movement relative to the precast components, said longitudinal movement resisting anchor extending outwardly from a medial portion of said outer surface of said connector body and wherein an interior portion of the wall of the precast component defines a groove to receive and hold said longitudinal movement resisting anchor.

20. The conduit connector according to claim 19, wherein the wall of the precast component is substantially continuous and has a predetermined thickness and said connector body has a thickness which is no greater than the thickness of the substantially continuous wall in which the conduit connector is embedded such that the conduit connector does not protrude outwardly beyond the precast component.

21. The conduit connector according to claim 19, wherein said connector body defines a longitudinal axis extending through the aperture, and wherein said at least one locking anchor comprises a rotation resisting anchor to engage the precast component and to secure the connector body against rotational movement about the longitudinal axis relative to the precast component.

22. The conduit connector according to claim 21, wherein the rotation resisting anchor comprises at least one angularly spaced apart longitudinally extending rib.

23. The conduit connector according to claim 19, wherein said longitudinal movement resisting anchor includes a circumferentially extending groove defined within said connector body wherein said circumferentially extending groove extends radially inward into said connector body to receive a corresponding inwardly projecting rib of the precast component.

24. The conduit connector according to claim 19, wherein said connector body has an inner diameter which is sized to snugly engage the conduit.

25. The conduit connector according to claim 19, wherein said connector body comprises thermoplastic material.

26. A unitary conduit connector which secures a conduit having a predetermined size and shape within a wall of a precast component of a drainage system such that the wall of the precast component surrounding the conduit connector is substantially continuous, the conduit connector comprising:

a unitary connector body defining an aperture having a predetermined shape and size which correspond to the predetermined shape and size of the conduit such that the conduit is snugly received within the aperture defined by said connector body, and said connector body having a predetermined thickness which is no greater than the thickness of the substantially continuous wall of precast component of the drainage system in which the conduit connector is embedded such that the conduit connector does not protrude outwardly beyond the precast component.

27. A conduit connector according to claim 26, wherein said connector body comprises an outer surface having at least one locking anchor to engage the precast component and to secure the connector body against movement within the precast component of the drainage system.

28. A conduit connector according to claim 27 wherein said at least one locking anchor further comprises a longitudinal movement resisting anchor to engage the precast component and to secure said connector body against longitudinal movement relative to the precast component.

29. A conduit connector according to claim 28, wherein said longitudinal movement resisting anchor includes a circumferentially extending groove within said connector body wherein said circumferentially extending groove extends radially inward into said connector body to receive a corresponding rib of the precast component.

30. A conduit connector according to claim 28, wherein said connector body defines a longitudinal axis extending through the aperture, and wherein at least one locking anchor comprises a rotation resistant anchor to engage to precast component and to secure the connector body against rotational movement about the longitudinal axis relative to the precast component.

31. A conduit connector according to claim 30, wherein the rotation resistant anchor comprises at least one angularly spaced apart longitudinally extending rib.

* * * * *